US005889371A

United States Patent [19]

Boyarsky et al.

[11] Patent Number: 5,889,371

[45] Date of Patent: Mar. 30, 1999

[54] ION SOURCE WITH POLE RINGS HAVING DIFFERING INNER DIAMETERS

[75] Inventors: David Boyarsky, Cherry Hill; Frank T. Zimone, Sewell, both of N.J.

[73] Assignee: Denton Vacuum Inc., Moorestown, N.J.

[21] Appl. No.: 853,834

[22] Filed: May 9, 1997

Related U.S. Application Data

[60] Provisional application No. 60/017,512, May 10, 1996.

[51] Int. Cl.[6] ..... H01J 27/102

[52] U.S. Cl. ..... 315/111.81; 250/423 R

[58] Field of Search ..... 315/111.81, 111.41; 250/423 R; 118/723 R, 723 E

[56] References Cited

U.S. PATENT DOCUMENTS

| | | | |
|---|---|---|---|
| 4,652,795 | 3/1987 | Lee et al. | 315/111.41 |
| 4,710,283 | 12/1987 | Singh et al. | 204/298 |
| 4,716,340 | 12/1987 | Lee et al. | 315/111.41 |
| 5,413,663 | 5/1995 | Shimizu et al. | 118/723 X |
| 5,468,363 | 11/1995 | Falabella | 315/111.41 X |
| 5,656,819 | 8/1997 | Greenly | 250/423 R |

OTHER PUBLICATIONS

Denton Vacuum, Inc., "CC–102R–Cold Cathode Ion Source System" Users Manual Feb. 1993.

*Primary Examiner*—Robert Pascal
*Assistant Examiner*—Justin P. Bettendorf
*Attorney, Agent, or Firm*—Norman E. Lehrer

[57] ABSTRACT

The improved ion source of the present invention includes upper and lower spaced apart but coaxially arranged magnetic pole rings having differing inner diameters. Because of the non-symmetry of the pole pieces or rings, the magnetic flux field created therebetween is non-symmetrical from top to bottom. This, and the arrangement and configuration of the anode ring located between the pole pieces, create an increased plasma region and higher plasma density resulting in increased thermal management, improved stoichiometry and increased density of the thin film devices being fabricated.

6 Claims, 1 Drawing Sheet

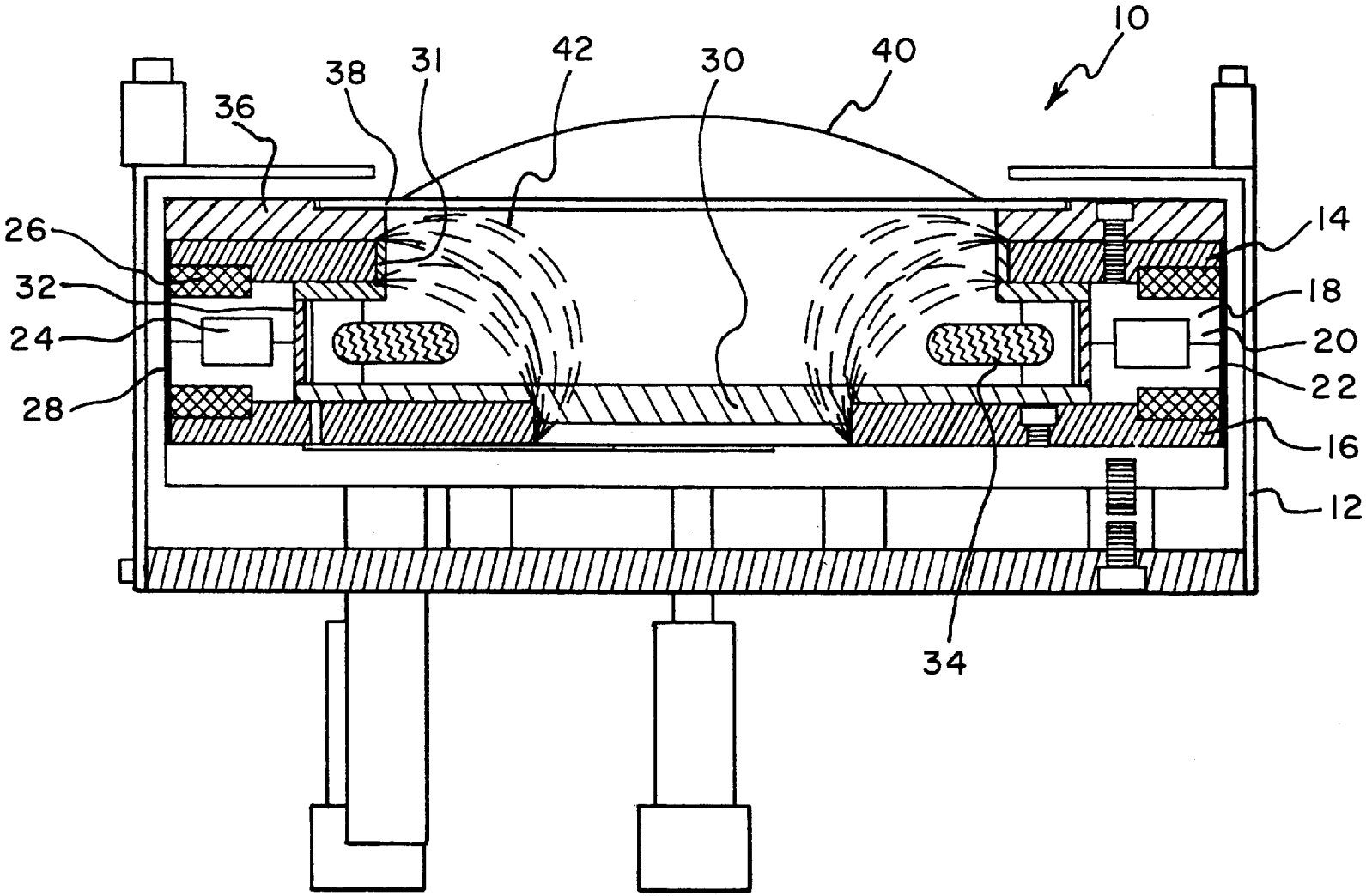
10
14
18
20
22
16
12
40
30
42
31
38
36
34
26
32
24
28

ION SOURCE WITH POLE RINGS HAVING DIFFERING INNER DIAMETERS

CROSS-REFERENCE TO RELATED APPLICATION

This application claims the benefit of U.S. Provisional Patent Application Ser. No. 60/017,512, filed May 10, 1996.

BACKGROUND OF THE INVENTION

Ion beam sources are used in a variety of applications including ion assisted deposition, co-deposition of materials, ion sputtering and the like. The present invention can be and is advantageously useful in all of the above-mentioned applications. However, the present device has particular utility in connection with the fabrication of a thin film device through ion assisted deposition.

As is well known in the art, if ion beams are employed in an ion assisted deposition during the preparation of thin film devices, the resulting thin films are characterized by many desirable properties which are otherwise not present. The use of ion beam sources is known to improve stoichiometry and to improve adhesion. The technique of using ion beams as part of a thin film deposition activity has also been used to modify stress and density in the deposited film, consequently reduce water vapor absorption. In particular with regard to optical thin film coatings, the refracted index is increased and the optical thin film stacks possess greater (long term) stability.

As is explained in U.S. Pat. No. 4,710,283, it is believed that ion bombardment, of both the substrate and the material being deposited, removes atoms that are not firmly entrenched in the substrate while at the same time other atoms of the material are driven more completely into the substrate. In addition, greater surface mobility for condensing atoms is provided. It is believed that when an ion beam is employed during thin film deposition, a film characterized by denser packing and better adhesion results.

As is also explained in prior U.S. Pat. No. 4,710,283, in a number of ion involved applications, an ion source capable of producing ions over a broad area, in response to applied low energy and low current is required. It had been the practice to employ a hot cathode along with a magnetic multipole source in order to obtain large area beams of ions having sufficient current density and beam energy. Hot cathode sources are very versatile and can be designed to produce beams of different sized areas and different current and energy intensities. However, since the hot cathode devices employ hot filaments within the ionization discharge chamber to thermally supply electrons, these arrangements have relatively short lifetimes. The lifetime of a filament can be increased by increasing the thickness thereof. However, thicker filaments require higher heating currents, thereby requiring larger power sources. In addition, hot filaments have been found to require large ionization discharge chambers.

U.S. Pat. No. 4,710,283 describes a cold cathode system which provides substantially all of the desirable features of a hot filament, magnetic multipole source, while not requiring a large ionization discharge chamber and not being characterized by a short filament lifetime. As can be seen from this prior patent, the preferred embodiment of that device includes a permanent magnet that is formed in a circle or ring shape having a cross section in the shape of the letter "C" with the opening of the "C" facing inwardly. The top side of the magnetic ring is formed as a north pole and the bottom as a south pole (or vice versa) so that magnetic flux passes out of the top of the magnetic ring into the bottom. As a result, there is an enclosure formed by the heavy magnetic flux passing between the upper and lower ends of the C-shaped section of the magnetic ring. An annularly shaped anode is located within this enclosure and is shielded by the magnetic flux. Located below the magnet is a cathode element and at the top of the magnet is an aperture that may be open or covered by a screen. The cathode also includes a port which permits an ionizable gas to be inserted into the region within the magnetic ring so that when an electrostatic field is produced between the anode and cathode, the ionizable gas is transformed into a dense plasma and ions become available to pass through the aperture in the form of an ion beam.

Similar ion beam sources are illustrated in U.S. Pat. Nos. 4,652,795and 4,716,340. The disclosures of each of the foregoing patents are incorporated herein by reference.

SUMMARY OF THE INVENTION

The present invention is an improvement in these prior ion sources and particularly on the cold cathode ion beam source shown in U.S. Pat. No. 4,710,283. The improved ion source of the present invention includes upper and lower spaced apart but coaxially arranged magnetic pole rings having differing inner diameters. Because of the non-symmetry of the pole pieces or rings, the magnetic flux field created therebetween is non-symmetrical from top to bottom. This, and the arrangement and configuration of the anode ring, create an increased plasma region and higher plasma density resulting in increased thermal management, improved stoichiometry and increased density of the thin film devices being fabricated.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

The sole FIGURE is a vertical cross-sectional view of the improved ion source of the present invention.

DETAILED DESCRIPTION OF THE PREFERRED EMBODIMENT

Referring now to the drawing in detail, there is shown in the single figure an improved ion source constructed in accordance with the principles of the present invention and designated generally as 10. The improved ion source 10 in the figure is shown in vertical cross section. The device is essentially circular or ring shaped. Accordingly, a vertical cross section running through the center of the device at any diameter would look substantially the same.

The ion source 10 is enclosed within a housing 12 and is comprised essentially of two ring-shaped magnetizable elements 14 and 16. Both the upper magnetizable member 14 and the lower magnetizable member 16 are preferably made from soft iron. As shown in the drawing, the outer diameters of the upper and lower magnetic pole rings 14 and 16 are substantially the same and are in alignment with each other as a result of the two pole pieces being coaxially arranged. The inner diameters, however, of the upper and lower magnetic pole pieces 14 and 16 are different in that the inner diameter of the lower pole piece 16 extends more inwardly toward the center of the device than the inner diameter of the upper pole piece 14.

Located between the upper and lower pole pieces 14 and 16 is an annular copper ring 18. The cooper ring 18 is preferably made of an upper ring part 20 and a lower ring part 22, each of which has a recess in its lower and upper surfaces, respectively, to form an annular internal channel 24 therein. Water or other liquid or fluid is passed through the channel 24 to cool the device thereby increasing the thermal management of the same.

A plurality of round permanent magnets 26 are inserted in recesses that are formed between the upper pole piece 14 and the upper part 20 of the copper ring 18 and similarly between the lower pole piece 16 and the lower part 22 of the copper ring 18. A shunt 28 in the form of a soft magnetic strip surrounds the outer periphery of the upper and lower pole pieces 14 and 16, the plurality of magnets 26 and the copper ring 18 to couple or shunt the upper and lower pole pieces.

Located within the device 10 is a lower pole ring shield 30 in the form of a liner which protects the lower pole piece 16 from the plasma generated in the ion source. The shield 30 may also be provided with a plurality of passages to serve as a distribution manifold for the introduction of ionizable gas into the ion source body. A liner in the form of an upper pole ring shield 31 protects the upper pole piece from the plasma generated in the ion source while an annular liner 32 functions as a center pole ring shield to protect the copper ring 18 from the plasma.

An anode ring 34 is mounted between the upper and lower pole pieces 14 and 16 and is electrically insulated therefrom. In the preferred embodiment, the anode ring 34 is elongated in cross section from left to right. That is, the anode ring 34 is flat in that it is wider than it is high. The innermost end of the anode ring 34 extends toward the center of the device further than the innermost edge of the upper pole piece 14. It does not, however, extend inwardly past the inward end of the lower pole piece 16.

Above the upper pole piece 14 is a top plate 36 in the form of an annular ring that protects the upper pole piece 14 and serves as the base for mounting a beam forming aperture 38 which may include a screen 40. The top plate 36 is electrically isolated from the source body and the anode ring 34 and is the element that can be biased (0 to 400 VDC) by the bias power supply (not shown).

In the preferred embodiment of the invention, the innermost portion of the anode ring 34 is exposed to the aperture 38. Because of the size and configuration of the anode ring 34, it provides a larger exposed area than heretofore contemplated or utilized.

The magnetic field or flux generated by the upper and lower pole pieces 14 and 16 is shown in the figure at 42. Because of the non-symmetry of the pole pieces 14 and 16, the magnetic field 42 is also non-symmetrical from top to bottom. This, and the arrangement and configuration of the anode ring 34, result in an increased plasma region and higher plasma density.

The present invention may be embodied in other specific forms without departing from the spirit or essential attributes thereof and accordingly reference should be made to the appended claims rather than to the foregoing specification as indicating the scope of the invention.

We claim:

1. A cold cathode ion beam source including coaxial but spaced apart upper and lower permanent magnet pole rings, an anode located between said pole rings and a beam forming aperture above said upper pole ring, each of said pole rings having an inner diameter and an outer diameter and being adapted to establish a magnetic flux field between the inner diameters of said upper and lower pole rings wherein the improvement comprises the inner diameter of one of said pole rings being smaller than the inner diameter of the other of said pole rings.

2. The improvement of claim 1 wherein the inner diameter of said upper pole ring is smaller than the inner diameter of said lower pole ring.

3. The improvement of claim 1 wherein said anode is in the form of a flat ring.

4. The improvement of claim 1 wherein the outer diameters of said pole rings are substantially equal.

5. The improvement of claim 1 further including means for introducing an ionizable gas into the area bounded by said pole rings.

6. The improvement of claim 1 wherein said anode is located within the area of said magnetic flux field established between the inner diameters of said upper and lower pole rings.

* * * * *